US010982937B2

(12) United States Patent
Menefee, III

(10) Patent No.: US 10,982,937 B2
(45) Date of Patent: Apr. 20, 2021

(54) CARTRIDGE LOADING PROCESS FOR BUFFERED SHOT SHELL LOADS

(71) Applicant: Polywad, Inc., Macon, GA (US)

(72) Inventor: James Y. Menefee, III, Macon, GA (US)

(73) Assignee: Polywad, Inc., Macon, GA (US)

( * ) Notice: Subject to any disclaimer, the term of this patent is extended or adjusted under 35 U.S.C. 154(b) by 281 days.

(21) Appl. No.: 16/250,245

(22) Filed: Jan. 17, 2019

(65) Prior Publication Data

US 2019/0226822 A1 Jul. 25, 2019

Related U.S. Application Data

(60) Provisional application No. 62/619,488, filed on Jan. 19, 2018.

(51) Int. Cl.

| | |
|---|---|
| ***F42B 33/02*** | (2006.01) |
| ***F42B 33/12*** | (2006.01) |
| ***F42B 7/04*** | (2006.01) |
| *F42B 33/00* | (2006.01) |

(52) U.S. Cl.

CPC ..... *F42B 33/025* (2013.01); *F42B 7/046* (2013.01); *F42B 33/02* (2013.01); *F42B 33/0207* (2013.01); *F42B 33/12* (2013.01); *F42B 33/002* (2013.01)

(58) Field of Classification Search

CPC .... F42B 33/02; F42B 33/0207; F42B 33/025; F42B 33/002; F42B 7/046; F42B 7/02; F42B 7/04

See application file for complete search history.

(56) References Cited

U.S. PATENT DOCUMENTS

| | | | | |
|---|---|---|---|---|
| 1,575,716 | A | 3/1926 | Pavek | |
| 3,343,444 | A * | 9/1967 | Lee | F42B 33/02 86/24 |
| 5,644,100 | A | 7/1997 | Puckett et al. | |
| 6,860,207 | B1 * | 3/2005 | Robertson | F42B 7/12 102/430 |
| 7,357,082 | B1 | 4/2008 | Racho | |
| 7,814,820 | B2 | 10/2010 | Menefee | |
| 8,276,519 | B2 | 10/2012 | Menefee, III et al. | |
| 2016/0298946 | A1 | 10/2016 | Meyer | |

OTHER PUBLICATIONS

Zutz, Don, Shotshell Data Manual, 1st ed., Hodgden Power Company, Shawnee Mission, Kansas, 1996, 14-25 (17 pp.).

* cited by examiner

*Primary Examiner* — Benjamin P Lee

(74) *Attorney, Agent, or Firm* — Eversheds Sutherland (US) LLP

(57) ABSTRACT

Disclosed are processes for loading a cartridge such as a shot shell with a shot load and a charge of buffer material. The processes employ a tube that is coaxially aligned with the axis of the cartridge case or shot cup, the tube having an outer diameter that closely fits into the inner diameter of the cartridge case or shot cup. Shot and buffer material are loaded, the leading edge of the tube is inserted to a sufficient depth to cause at least a portion of the shot load and buffer material to rise into the inner volume of the tube, and the tube removed. The insertion-removal cycle effects the efficient mixing of the shot and the buffer material and can be repeated as many times as desired.

24 Claims, 1 Drawing Sheet

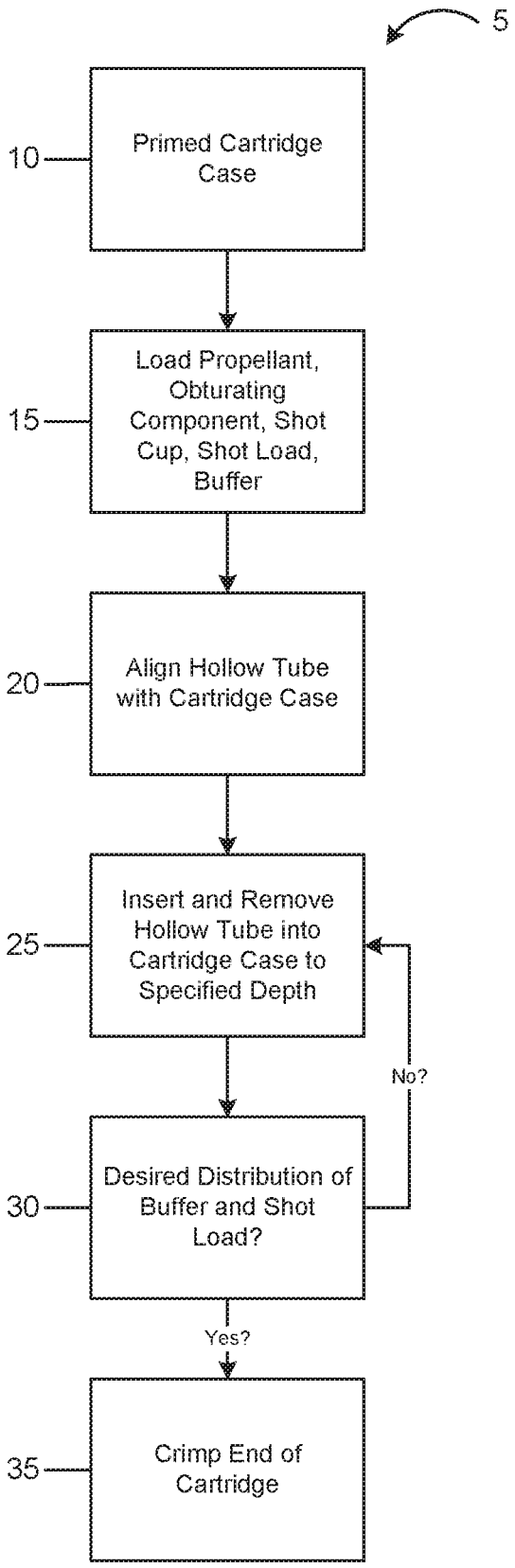
5
10
Primed Cartridge Case
15
Load Propellant, Obturating Component, Shot Cup, Shot Load, Buffer
20
Align Hollow Tube with Cartridge Case
25
Insert and Remove Hollow Tube into Cartridge Case to Specified Depth
No?
30
Desired Distribution of Buffer and Shot Load?
Yes?
35
Crimp End of Cartridge

CARTRIDGE LOADING PROCESS FOR BUFFERED SHOT SHELL LOADS

CROSS-REFERENCE TO RELATED APPLICATIONS

This application claims the benefit of priority to U.S. Provisional Patent Application No. 62/619,488, filed Jan. 19, 2018, which is incorporated herein by reference in its entirety.

TECHNICAL FIELD

This disclosure relates to processes for loading cartridges such as shot shell cartridges, particularly processes for loading buffered shot shell loads.

BACKGROUND

Cartridge systems constitute extremely practical constructions and methods for deploying almost any payload or projectile downrange. Typical cartridge systems incorporate the desired payload, a propellant, and a priming composition all within a self-contained unit. Ammunition cartridges such as shot shells are prototypical of cartridge devices, although cartridge systems have been used to launch non-lethal payloads such as tracer, signaling, or non-lethal projectile loads to exploit their specific function. All of these cartridge systems, including shot shells, typically employ additional and often complex components beyond the nominal propellant, projectile, and primer for their effective delivery of projectiles or other payloads. For example, shot shell wads designed for various functions such as providing a seal against expanding propellant gases, containing and stabilizing the projectile(s) for a desired distance downrange, and/or cushioning and barrel protection, are almost invariably employed in modern cartridge systems.

One component that has been useful in certain shot shell cartridges is a so-called buffer or buffer component or material. A buffer is a granular material that is usually made of a polymer such as polyethylene or polypropylene, and which is mixed with the shot itself in the shot shell cartridge. Buffer can be used in birdshot or buckshot loads and when properly mixed with the shot, can provide several advantages. For example, properly buffered loads may insulate and isolate individual shot pellets from each other, lessening the transmission of energy between and among pellets. This effect may be reflected in tighter shot patterns and shorter shot strings. For softer pellets such as lead loaded with softer buffer material, buffering may provide some cushioning effect when the shot is fired from the cartridge, reducing shot deformation and improving shot patterns.

Although useful in certain shot shell loads, buffer can be difficult, time-consuming, and therefore costly to load. For example, adequate mixing of the shot and buffer to form a reasonably homogeneous mixture is typically needed for the buffer to have its optimal effect. Conventionally, cartridges loaded with shot and a buffer material are subjected to vibration process to mix the shot and buffer. This method not only slows the loading process and increases cost, but it can also provide inadequate or inconsistent mixing of shot and buffer. Therefore, new processes are needed for loading shot shells (or cartridges generally) with projectiles such as shot and a buffer, which provides a more uniform distribution of projectiles and buffer material, and which enhances the efficiency of the loading process. More uniform distribution of shot and buffer can, for example, provide a more consistent and predictable shot patterns on target.

SUMMARY

This disclosure provides for, among other things, new processes for loading a cartridge such as a shot shell cartridge, with a load of shot projectiles and a charge of buffer material. The disclosed processes can provide more uniform distributions of the projectiles such as shot and the buffer material, and can improve the efficiency and lower the cost of the loading process. While the descriptions of these processes are typically set out using shot shells, and buffered shot loads are exemplary, it is to be understood that the methods described herein can be used to load any small projectile payload and any buffer in an appropriate cartridge.

In an aspect, the disclosed processes employ a tube that is used in the loading process that is coaxially aligned with the axis of the cartridge case, and wherein the outer diameter of the tube closely fits into the inner diameter of a shot cup, or the cartridge case itself when no shot cup is used. Once the shot load and the buffer material are charged to the shot cup or cartridge in any order, the leading edge of the tube is inserted into the shot cup or the cartridge case itself to a sufficient depth to cause at least a portion of the shot load and buffer material to rise into the inner volume of the tube. The tube is then removed from the shot cup or the cartridge case (when no shot cup is used) to mix the shot and buffer. This insertion-removal cycle effects the mixing of the shot load with the buffer material and, if desired or needed, can be repeated as many times as desired to afford a selected degree or extent of mixing. Typically, this process will be carried out on automated loading machines, where one or more insertion and removal steps can be carried out at individual loading stations. Therefore, the removal step involves the complete removal of the tube from the shot cup or cartridge case. This process also can be used in hand-loading scenarios, in which case the removal step can involve the partial or complete removal of the tube from the shot cup or cartridge case, and the tube is then completely removed after the final inserting step for further processing such as crimping the case.

In one aspect, the processes according to this disclosure can be used to load a cartridge with propellant, an obturating component, usually a shot cup of some type, and a shot load and charge of buffer materials. Any type of obturating component can be used and any type of shot cup can be used. For example, the shot cup and the obturating component can be combined into a single wad, in which the obturating component is at the aft end adjacent the propellant and the shot cup at the fore end. Some wads of this type include a collapsible section between the shot cup and the powder obturating section. Alternatively, the obturating component can be a separate component and can be selected from a preformed gas seal or a granular obturating medium. With a separate obturating component, a shot cup without an obturating section and/or collapsible section can be employed. Alternatively, the disclosed processes can be used to load buffer and the selected solid projectiles, such as shot, into cartridge without the use of a projectile cup or shot cup.

In an aspect, this disclosure provides a process for loading a buffered shot shell cartridge, the process comprising:

a) providing or obtaining a cartridge case having a fore end and an aft end, the cartridge case having an inner diameter and comprising a cartridge head and a primer at the aft end;

b) sequentially loading into the cartridge case [i] a propellant adjacent the primer, [ii] an obturating component, [iii] a shot cup having an inner diameter, and [iv] in any order, a shot load and a buffer charge;

c) coaxially aligning a tube with the axis of the cartridge case, wherein the tube has a length, a circular leading edge, an outer diameter, an inner wall, a wall thickness, and an inner volume, and wherein the outer diameter of the tube closely fits into the inner diameter of the shot cup; and d) one or more times, sequentially [i] inserting the leading edge of the tube into the shot cup to a sufficient depth to cause at least a portion of the shot load and buffer charge to rise into the inner volume, of the tube, and [ii] removing the tube from the shot cup.

In another aspect, the disclosed process can be used to load a cartridge which does not use a separate shot cup to contain the shot charge and buffer, but can be applied to load the shot and buffer directly into the cartridge itself to attain the desired distribution or uniformity of the shot and buffer mix. In this aspect, this disclosure provides a process for loading a buffered shot shell cartridge, the process comprising:

a) providing or obtaining a cartridge case having a fore end and an aft end, the cartridge case having an inner diameter and comprising a cartridge head and a primer at the aft end;

b) sequentially loading into the cartridge case [i] a propellant adjacent the primer, [ii] an obturating component, and [iii] in any order, a shot load and a buffer charge;

c) coaxially aligning a tube with the axis of the cartridge case, wherein the tube has a length, a circular leading edge, an outer diameter, an inner wall, a wall thickness, and an inner volume, and wherein the outer diameter of the tube closely fits into the inner diameter of the cartridge case; and d) one or more times, sequentially [i] inserting the leading edge of the tube into the cartridge case to a sufficient depth to cause at least a portion of the shot load to rise into the inner volume of the tube, and [ii] removing the tube from the cartridge case.

These and other aspects and embodiments of the disclosed cartridges and methods are described more fully in the detailed description and FIGURE, further disclosure, and appended claims.

BRIEF DESCRIPTION OF THE DRAWINGS

Various aspects and embodiments of this disclosure are illustrated in the drawings in which lie reference characters designate the same or similar parts throughout the FIGURES.

FIG. 1 illustrates a flowchart view of a representative embodiment of a process for distributing buffer material and shot within a shot cup to the desired distribution.

DETAILED DESCRIPTION

This disclosure generally describes a method for distributing buffer material and shot pellets within a shot cup or cartridge more effectively and efficiently that conventional methods, and that can improve the ease and economics of loading buffered loads. The method disclosed herein loads several components together within a cartridge case, including a primer, propellant, a shotcup, shot load, and buffer, then uses the disclosed process to evenly distribute the shot load and buffer material.

Cartridge Loading Process

Portions of this disclosure discuss methods as exemplary steps that can accomplish the desired distribution of shot pellets and buffer material within a shot cup or cartridge itself, and these steps may be discussed in terms of shot shell cartridges. However, the disclosure and the claims are not limited to any particular type of cartridge, shot payload, shot size, or other aspects for loading a cartridge.

For example, in one aspect, there is provided a process for loading a buffered shot shell cartridge, the process comprising:

a) providing or obtaining a cartridge case having a fore end and an aft end, the cartridge case having an inner diameter and comprising a cartridge head and a primer at the aft end;

b) sequentially loading into the cartridge case [i] a propellant adjacent the primer, [ii] an obturating component, [iii] a shot cup having an inner diameter, and [iv] in any order, a shot load and a buffer charge;

c) coaxially aligning a tube with the axis of the cartridge case, wherein the gibe has a length, a circular leading edge, an outer diameter, an inner wall, a wall thickness, and an inner volume, and wherein the outer diameter of the tube closely fits into the inner diameter of the shot cup; and d) one or more times, sequentially [i] inserting the leading edge of the tube into the shot cup to a sufficient depth to cause at least a portion of the shot load and buffer charge to rise into the inner volume, of the tube, and [ii] removing the tube from the shot cup.

In accordance with another aspect, this disclosure provides a process for loading a buffered shot shell cartridge that does not use a shot cup, the process comprising:

a) providing or obtaining a cartridge case having a fore end and an aft end, the cartridge case having an inner diameter and comprising a cartridge head and a primer at the aft end;

b) sequentially loading into the cartridge case [i] a propellant adjacent the primer, [ii] an obturating component, and [iii] in any order, a shot load and a buffer charge;

c) coaxially aligning a tube with the axis of the cartridge case, wherein the tube has a length, a circular leading edge, an outer diameter, an inner wall, a wall thickness, and an inner volume, and wherein the outer diameter of the tube closely fits into the inner diameter of the cartridge case; and d) one or more times, sequentially [i] inserting the leading edge of the tube into the cartridge case to a sufficient depth to cause at least a portion of the shot load to rise into the inner volume of the tube, and [ii] removing the tube from the cartridge case.

In an aspect, the above process can also use a filler material within the shot cup or cartridge, the filler material being added below the shot and buffer charges, above the shot and buffer charges, or both below and above the shot and buffer charges. In one aspect, buffer material itself can be used a filler material above and/or below the shot charge. Alternatively, conventional filler materials such as resin pellets that are typically larger than buffer material and not usually viewed as buffer material can be used. Alternatively still, any combination of filler material and buffer material can be used according to this disclosure. In another aspect, when referring to use of a buffer in this disclosure, the processes can also be used solely with conventional filler materials in combination with a shot load to provide mixed shot and filler in a cartridge. Moreover, filler material can be used in cartridge or shot cup after the sequential tube insertion and removal step(s) to fill any remaining space at the fore end of the cartridge case prior to crimpling or closing the case. In a further aspect and embodiment, the filler and/or buffer material and shot load can be added in portions, in any desired sequence in the shot cup or cartridge and then subjected to these combined materials to the step of sequentially [i] inserting the leading edge of the tube into the shot cup or cartridge to a sufficient depth to cause at least a portion of the shot load and buffer material to rise into the inner volume of the tube, and [ii] removing the tube from the cartridge case.

In one aspect, the disclosed process can use an obturating component that can comprise or can be selected from a preformed gas seal or can be a granular obturating medium. The preformed gas seal can be part of a larger wad that can include a shot cup, or it can be a stand-alone preformed gas seal. The obturating component also can be a granular obturating medium, such as disclosed in U.S. Pat. Nos. 7,814,820 and 8,276,519, each of which is incorporated herein by reference in their entireties. Further to this aspect, the obturating component can be an over-propellant preformed gas seal that is combined with the shot cup, that is both the obturating component, the preformed gas seal, and if desired, a collapsible section can be combined into a single wad, such as those described in the following publications, each of which is incorporated herein by reference in its entirety: Thomas J. Griffin, ed., *Shot shell Reloading Handbook,* 5$^{th}$ ed., Lyman Publications, Lyman Products Corporation, Middletown, Conn. (2007); and Don Zutz, *Hodgdon Powder Company Shot shell Data Manual,* 1$^{st}$ ed., Hodgden Power Company, Shawnee Mission, Kans. (1996). In one aspect, the components of the cartridge and shot shell, including the buffer, can be conventional components. However, the process for loading the buffered shot is different from any prior loading process.

FIG. 1 illustrates a flow chart of one representative embodiment of a loading process 5. The loading process 5 first provides a cartridge case 10 which is typically a primed cartridge case. The process 5 can be a hand loading process or a machine loading process, and the cartridge can be secured to the appropriate loading equipment according to the process. Once the cartridge case such as a primed cartridge case is in place, the process loads into the cartridge the desired components such as the propellant, obturating component (which can be a separate component or part of the shot cup), shot cup, shot load and buffer charge 15, with the shot load and buffer charge being added in any order. Once loaded, a hollow tube is brought into coaxial alignment with the cartridge case 20 where the tube closely fits the inner diameter of the shot cup or cartridge case if no shot cup is used. The hollow tube is maintained in its coaxial orientation while it is sequentially inserted into the shot cup or cartridge case to a desired depth 25 and then and removed from the shot cup or cartridge. This insertion and removal step can be carried out any number of times to achieve the desired distribution of buffer and shot 30 within the shot cup or cartridge case. Typically from only one to about 3 or 4 insertions are used to achieve the desired distribution, which is typically a homogeneous distribution of buffer and shot. After the buffer and shot load are distributed or mixed as desired, any further components can be added or further processing can be employed. Further processing includes having the end of the cartridge crimped 35 to contain the components within the cartridge case.

While not intending to be bound by theory, it is thought that the insertion of the tube into the undistributed buffer and shot charges causes disruption of the stacking pattern that the shot has assumed upon its initial addition into the shot cup or cartridge. Initially, the leading edge of the tube can impart energy to the shot that is situated around the inner diameter of the shot cup (or cartridge itself), which the tube contacts upon its insertion, and further energy is imparted from the tube to the shot and buffer combination as the tube is inserted deeper into the shot cup or cartridge. Again, while not theory-bound, the contact and kinetic energy applied by the penetrating tube imparts a "billiard ball" effect to the entire collection of shot, causing sufficient separation of at least some of the shot to allow admixing of the buffer with the shot. That is, mixing occurs by inserting the tube into the shot cup or cartridge case to a sufficient depth to cause at least a portion of the shot load and buffer to rise into the inner volume of the tube, and subsequently removing the tube from the shot cup or cartridge case and repeating the insertion-removal sequence if desired. Again, while not theory-bound, it is thought that providing energy to disrupt the stacking pattern which the shot initially assumed upon loading is occurring.

If the cartridge is being loaded in such a manner that the cartridge can be maintained at a single station while the tube is inserted and removed multiple times, such as but not limited to a hand loading process, then the step of removing the tube from the shot cup or cartridge following an insertion step can be carried out by partially or completely removing the tube from the shot cup or cartridge. The final removal step completely removes the tube from the shot cup or cartridge so that crimping can be effected. However, the disclosed process can be carried out on automated loading machines, where one or more insertion and removal steps can be carried out at individual loading stations, in which case the removal step involves the complete removal of the tube from the shot cup or cartridge case.

According to another aspect, the process can further include the step of crimping, closing, or sealing the cartridge case. For example, the process can further include the step of crimping the cartridge case using a star crimp or a roll crimp. Star (or pie) crimps can be, for example, 6-point or 8-point crimps, as desired.

Sequential Insertion and Removal of the Tube

According to an aspect of this disclosure, the process can include the step of sequentially inserting and removing the tube a single time, that is, one time. In some cartridges and their respective payloads, a single insertion-removal cycle is sufficient to provide the desired mixing of the buffer and shot. In another aspect, the step of sequentially inserting and removing the tube can be carried out n times, wherein n is from 1 to 20 times, from 1 to 10 times, from 1 to 5 times, from 1 to 4 times, or from 2 to 3 times. The step of sequentially inserting and removing the tube can be carried out 1, 2, 3, 4, 5, 6, 7, 8, 9, 10, 11, 12, 13, 14, 15, 16, 17, 18, 19, or 20 times, or any number of times between and including these numbers, such as from 1 to 3 or from 2 to 5 times. Any number of combinations of inserting the leading edge of the tube into the cartridge or shot cup may occur, followed by removing the tube can be used.

According to another aspect, at least one of the steps of inserting and removing the tube into the shot cup or cartridge case comprises inserting the leading edge of the tube into the shot cup until it contacts the bottom of the cup. However, it is not necessary for any insertion-removal step to completely contact the bottom of the cup. In a further aspect, the step of sequentially inserting and removing the tube is carried out n times, wherein n is from 1 to 10 times, and wherein the depth of insertion of the tube in each of the second or greater step can be the same or greater than the depth of insertion in the previous step. Further, the step of sequentially inserting and removing the tube is carried out n times, wherein n is from 1 to 10 times, and wherein the depth of insertion of the tube in each of the second or greater step can be the same or less than the depth of insertion in the previous step.

The insertion step(s) can be adjusted with respect to the number of insertion steps and the depth of insertion of each step, in order to attain the desired mixing, as readily appreciated by the skilled person. For example, in one aspect of the process, at least one step of sequentially inserting and removing the tube can comprise inserting the tube to the bottom of the shot cup. In another aspect, at least one step of sequentially inserting and removing the tube can comprises inserting the tube at least halfway to the bottom of the shot cup.

In a further aspect, the at least one step of sequentially inserting and removing the tube can comprise inserting the tube into the shot cup or cartridge to a sufficient depth that at least or about half of the shot load and/or buffer charge rises into the inner volume of the tube. In another aspect, at least one step of sequentially inserting and removing the tube can comprise inserting the tube into the shot cup or cartridge to a sufficient depth that less than half of the shot load and/or buffer charge rises into the inner volume of the tube.

Generally, the tube used in the insertion and removal step can have a wall thickness that is less than about 50%, 25%, 15%, 10% or 5% of the average diameter or size of the smallest shot being loaded. Thus, the wall thickness of the tube can be less than or about half the diameter of the smallest shot in the shot load. In an aspect, the tube can have a wall thickness of from about 0.005 inch to about 0.025 inch, or from about 0.010 inch to about 0.015 inch. For example, the tube can have a wall thickness of about 0.005 inch, 0.006 inch, 0.007 inch, 0.008 inch, 0.009 inch, 0.010 inch, 0.011 inch, 0.012 inch, 0.013 inch, 0.014 inch, 0.015 inch, 0.016 inch, 0.017 inch, 0.018 inch, 0.019 inch, 0.020 inch, 0.021 inch, 0.022 inch, 0.023 inch, 0.024 inch, or about 0.025 inch, or any range between any of the thickness values.

In a further aspect, the circular leading edge of the tube that is the first part of the tube to be inserted into the shot cup or cartridge can be beveled. Generally, the beveling is imparted from the outer diameter in the direction of the inner diameter such that the beveling aids in the insertion of the tube. Along the inner wall of the tube, the tube can comprise one or more projections and/or indentions, which can also play a part in imparting energy to the shot charge. The inner wall of the tube also can be tapered from the leading edge upward, to form a cone-shaped inner wall. This tapering also can help impart energy to the shot charge. The tube can comprise, consist of, or consist essentially of a non-sparking material, such as for example, brass or a sufficiently hard polymer material such as a thermoset polymer. Regarding the outer diameter of the tube that "closely fits" into the inner diameter of the shot cup or cartridge case, there are various measures that can be used to reflect a fit that is "close", as explained in the definitions section of this disclosure.

Buffer and Shot Components

Generally, the buffer and shot components used in the disclosed process, as well as the other components of the cartridge, are well understood by the person of ordinary skill. For example, the buffer charge can comprise a polymer, such as a thermoplastic polymer. In one aspect, the buffer charge can comprise polyethylene, polypropylene, polystyrene, polyester such as polyethylene terephthalate, polyamide, or a combination thereof. Mixing resin beads of various sizes, shapes, or hardness levels can be used to provide a good buffer effect, while also providing some advantages for ease of dispensing and mixing. Generally, aspects of the most suitable buffers include selecting the size, shape, hardness and density that is economically viable and provides the suitable buffer performance.

According to one aspect of this disclosure, the average buffer size (that is, average diameter) can be about the size of the shot that is loaded in combination with the buffer. Shot sizes can be found in any loading reference, such as Thomas J. Griffin, ed., *Shot shell Reloading Handbook,* $5^{th}$ ed., Lyman Publications, Lyman Products Corporation, Middletown, Conn. (2007). For example, if loading a number 8 (#8) shot, the buffer can be about 0.110 inch in size (average diameter), where if loading #7½ shot, the buffer can be about 0.095 inch in size (average diameter).

In another aspect, the buffer can be considerably larger or considerably smaller than the shot they are loaded with. For example, buffer such as polystyrene buffer beads that are as small as 0.004 inch to 0.002 inch can be used with substantially larger shot, for example, most birdshot. In another example, polyethylene resin beads as large as up to about 0.170 inch or 0.190 inch in diameter can be used with a substantially smaller shot, such as number 7½ (#7½) shot, which has a size of 0.095 inch. Accordingly, any buffer size ranges between the above sizes can be used. For example, the present process can use a buffer size of from about 0.002 inch to about 0.190 inch. Alternatively, the present process can use a buffer size of from about 0.010 inch to about 0.150 inch, or alternatively, from about 0.020 inch to about 0.120 inch. For example, the present process can use an average buffer size of about 0.002 inch, 0.005 inch, 0.010 inch, 0.012 inch, 0.015 inch, 0.020 inch, 0.025 inch, 0.030 inch, 0.035 inch, 0.040 inch, 0.045 inch, 0.050 inch, 0.055 inch, 0.060 inch, 0.065 inch, 0.070 inch, 0.075 inch, 0.080 inch, 0.085 inch, 0.090 inch, 0.095 inch, 0.100 inch, 0.105 inch, 0.110 inch, 0.115 inch, 0.120 inch, 0.125 inch, 0.130 inch, 0.135 inch, 0.140 inch, 0.145 inch, 0.150 inch, 0.155 inch, 0.160 inch, 0.165 inch, 0.170 inch, 0.175 inch, 0.180 inch, 0.185 inch, 0.190 inch, or 0.120 inch, including any ranges between these sizes, and any combinations of these sizes when two or more different sized buffer materials are used.

Therefore, the process of the present disclosure can be used with any combination of solid projectile size and buffer size. In a further aspect, more dense buffer materials can be used to prevent or reduce blowback into the face of the shooter when shooting the shot shell in high winds. For example, in one aspect, the buffer material has a density that is greater than or about 1.0 g/cm$^3$. Polyethylene terephthalate provides good performance in this aspect of being sufficiently dense that blowback into the face of the shooter is less of a problem than with some lower density resins such as low-density polyethylene. In some aspects, the buffer material can be less than or about 1.0 g/cm$^3$.

In an aspect, the amount of buffer used with the disclosed process can vary, as the person of skill will appreciate, for example, depending upon the amount of available space that is required to be filled in the shot cup or cartridge. In this aspect, a separate filler material can be used below, above, or both above and below the shot charge and buffer material. The buffer material itself can be used as a filler material in this manner. The present process can be used with any amount of buffer and any amount of shot that can be used in the available shot cup and cartridge.

Accordingly, it is sometimes desirable to adjust the bulk of the shot shell load, for example, when the available shot cup or wad is too large to be filled with the desired load of shot. In this event, sufficient buffer can be mixed with the required shot load throughout the available volume of the shot cup or the cartridge. In addition, buffer material can be placed beneath the shot charge by loading into the shot cup before the shot and/or buffer material can be placed on top of the shot load before or after the insertion and removal step(s), for example, to aid in crimping the cartridge. Again, using a buffer charge below or on top of the mixed shot-buffer charge without mixing it with the shot load as disclosed can lead to some settling or migration of the dissimilar sized particles over time, particularly with handling and transportation. Therefore, typically, when added to the cartridge in this manner, thorough mixing according to the process of this disclosure is employed.

In an aspect, the disclosed process can be used with any size of birdshot, buckshot, or a combination thereof such as in a multiplex load that contains a combination of shot of two or more different sizes. For example, the shot load can comprise shot having a shot size from #BB lead pellet size to #12 lead pellet size; alternatively, from #2 lead pellet size to #10 lead pellet size; or alternatively, from #4 lead pellet size to #9 lead pellet size. In a further aspect, the shot load or payload can comprise shot pellets having a shot size of #12, #11, #10, #9, #8, #7½, #6, #5, #4, #3, #2, #1, or #BB lead pellet size, or any combinations thereof, projectiles equivalent to these shot sizes. Moreover, the shot charge can comprises projectiles of different sizes, composition, hardness, or any combination thereof.

According to another aspect, the shot load can contain shot of any metal, alloy or material used for shot. For example, and not by way of limitation, the disclosed process can be used to load buffered loads of lead, steel, bismuth, tungsten, tin, iron, copper, zinc, aluminum, nickel, chromium, molybdenum, cobalt, manganese, antimony, alloys thereof, composites thereof, and any combinations thereof. This process can also be used to load a cartridge case of any gauge, such as any shot shell gauge.

Additional Aspects

The following additional aspects, embodiments, and examples are provided as further disclosure and description.

Aspect 1. A process for loading a buffered shot shell cartridge, the process comprising:

a) providing or obtaining a cartridge case having a fore end and an aft end, the cartridge case having an inner diameter and comprising a cartridge head and a primer at the aft end;

b) sequentially loading into the cartridge case [i] a propellant adjacent the primer, [ii] an obturating component, [iii] a shot cup having an inner diameter, and [iv] in any order, a shot load and a buffer charge;

c) coaxially aligning a tube with the axis of the cartridge case, wherein the tube has a length, a circular leading edge, an outer diameter, an inner wall, a wall thickness, and an inner volume, and wherein the outer diameter of the tube closely fits into the inner diameter of the shot cup; and d) one or more times, sequentially [i] inserting the leading edge of the tube into the shot cup to a sufficient depth to cause at least a portion of the shot load and buffer charge to rise into the inner volume of the tube, and [ii] removing the tube from the shot cup.

Aspect 2. A process for loading a buffered shot shell cartridge, the process comprising:

a) providing or obtaining a cartridge case having a fore end and an aft end, the cartridge case having an inner diameter and comprising a cartridge head and a primer at the aft end;

b) sequentially loading into the cartridge case [i] a propellant adjacent the primer, [ii] an obturating component, and [iii] in any order, a shot load and a buffer charge;

c) coaxially aligning a tube with the axis of the cartridge case, wherein the tube has a length, a circular leading edge, an outer diameter, an inner wall, a wall thickness, and an inner volume, and wherein the outer diameter of the tube closely fits into the inner diameter of the cartridge case; and d) one or more times, sequentially [i] inserting the leading edge of the tube into the cartridge case to a sufficient depth to cause at least a portion of the shot load to rise into the inner volume of the tube, and [ii] removing the tube from the cartridge case.

Aspect 3. A process according to any one of aspects 1-2, further comprising the step of crimping the cartridge case.

Aspect 4. A process according to any one of aspects 1-2, further comprising the step of crimping the cartridge case using a star crimp or a roll crimp.

Aspect 5. A process according to aspect 1, wherein the shot cup and the obturating component are combined into a single wad.

Aspect 6. A process according to any one of aspects 1-2, wherein the obturating component is selected from a preformed gas seal or a granular obturating medium.

Aspect 7. A process according to any one of aspects 1-2, wherein the obturating component is a preformed gas seal.

Aspect 8. A process according to any one of aspects 1-7, wherein the wall thickness of the tube is from about 0.010 inch to about 0.015 inch.

Aspect 9. A process according to any one of aspects 1-7, wherein the wall thickness of the tube is less than or about half the diameter of the smallest shot in the shot load.

Aspect 10. A process according to any one of aspects 1-7, wherein the tube comprises projections or indentions on the inner wall.

Aspect 11. A process according to any one of aspects 1-7, wherein the inter wall of the tube is tapered from the leading edge to form a cone-shaped inner wall.

Aspect 12. A process according to any one of aspects 1-7, wherein the circular leading edge of the tube is beveled.

Aspect 13. A process according to any one of aspects 1-7, wherein the tube comprises a non-sparking material.

Aspect 14. A process according to any one of aspects 1-7, wherein the tube is brass.

Aspect 15. A process according to any one of aspects 1-14, wherein the step of sequentially inserting and removing the tube is carried out n times, wherein n is from 1 to 10 times.

Aspect 16. A process according to any one of aspects 1-14, wherein the step of sequentially inserting and removing the tube is carried out n times, wherein n is from 1 to 4 times.

Aspect 17. A process according to any one of aspects 1-14, wherein the step of sequentially inserting and removing the tube is carried out 1 time.

Aspect 18. A process according to any one of aspects 1 or 3-12, wherein at least one step of sequentially inserting and removing the tube comprises inserting the leading edge of the tube into the shot cup until it contacts the bottom of the shot cup.

Aspect 17. A process according to any one of aspects 1-14, wherein the step of sequentially inserting and removing the tube is carried out n times, wherein n is from 1 to 10 times, and wherein the depth of insertion of the tube in each of the second or greater step is the same or greater than the depth of insertion in the previous step.

Aspect 18. A process according to any one of aspects 1-14, wherein the step of sequentially inserting and removing the tube is carried out n times, wherein n is from 1 to 10 times, and wherein the depth of insertion of the tube in each of the second or greater step is the same or less than the depth of insertion in the previous step.

Aspect 19. A process according to any one of aspects 1 or 3-15, wherein at least one step of sequentially inserting and removing the tube comprises inserting the tube to the bottom of the shot cup.

Aspect 20. A process according to any one of aspects 1 or 3-12, wherein at least one step of sequentially inserting and removing the tube comprises inserting the tube at least halfway to the bottom of the shot cup.

Aspect 21. A process according to any one of aspects 1 or 3-15, wherein at least one step of sequentially inserting and removing the tube comprises inserting the tube into the shot cup or cartridge to a sufficient depth that at least or about half of the shot load rises into the inner volume of the tube.

Aspect 22. A process according to any one of aspects 1-14, wherein at least one step of sequentially inserting and removing the tube comprises inserting the tube into the shot cup or cartridge to a sufficient depth that less than half of the shot load rises into the inner volume of the tube.

Aspect 23. A process according to any one of aspects 1-22, wherein the buffer charge comprises a thermoplastic polymer.

Aspect 24. A process according to any one of aspects 1-22, wherein the buffer charge comprises polyethylene, polypropylene, polystyrene, polyester (such as polyethylene terephthalate), polyamide, or a combination thereof.

Aspect 25. A process according to any one of aspects 1-22, wherein the buffer charge comprises polymer particles having an average size of from about 0.002 inch to about 0.190 inch.

Aspect 26. A process according to any one of aspects 1-25, wherein the shot load comprises birdshot, buckshot, or a combination thereof.

Aspect 27. A process according to any one of aspects 1-25, wherein the shot load comprises shot having a shot size from #BB lead pellet size to #12 lead pellet size; alternatively, from #2 lead pellet size to #10 lead pellet size; or alternatively, from #4 lead pellet size to #9 lead pellet size.

Aspect 28. A process according to any one of aspects 1-25, wherein the shot load comprises shot pellets having a shot size of #12, #11, #10, #9, #8, #7½, #6, #5, #4, #3, #2, #1, or #BB lead pellet size.

Aspect 29. A process according to any one of aspects 1-25, wherein the shot load comprises lead, steel, bismuth, tungsten, tin, iron, copper, zinc, aluminum, nickel, chromium, molybdenum, cobalt, manganese, antimony, alloys thereof, composites thereof, and any combinations thereof.

Aspect 30. A process according to any one of aspects 1-25, wherein the shot load comprises a multiplex shot load comprising shot of two or more different sizes.

Aspect 31. A process according to any one of aspects 1-25, wherein the shot load comprises projectiles of different sizes, compositions, hardness, or any combination thereof.

Aspect 32. A process according to any one of aspects 1-31, wherein the cartridge case is a cartridge case of any gauge.

Aspect 33. A process for loading a cartridge with a buffered slut shell cartridge, the process comprising:

a) providing or obtaining a cartridge case having a fore end and an aft end, the cartridge case having an inner diameter and comprising a cartridge head and a primer at the aft end;

b) sequentially loading into the cartridge case [i] a propellant adjacent the primer, [ii] a wad comprising a obturating section and a shot cup, the shot cup having an inner diameter, and [iii] in any order, a shot load and a buffer charge;

c) providing or obtaining a tube having a length, a circular leading edge, an outer diameter, an inner wall, a wall thickness, and an inner volume, wherein the tube is coaxially aligned with the axis of the cartridge case, and wherein the outer diameter of the tube closely fits into the inner diameter of the shot cup;

d) two or more times, sequentially [i] inserting the leading edge of the tube into the shot cup to a sufficient depth to cause at least a portion of the shot load and buffer to rise into the inner volume of the tube, and [ii] removing the tube from the shot cup, wherein the tube is completely removed from the shot cup after the final inserting step; and e) crimping or closing the cartridge case.

Aspect 34. A process for loading a cartridge with a buffered shot shell cartridge, the process comprising:

a) providing or obtaining a cartridge case having a fore end and an aft end, the cartridge case having an inner diameter and comprising a cartridge head and a primer at the aft end;

b) sequentially loading into the cartridge case [i] a propellant adjacent the primer, [ii] an obturating component, [iii] a shot cup having an inner diameter, and [iv] in any order, a shot load and a buffer charge;

c) providing or obtaining a tube having a length, a circular leading edge, an outer diameter, an inner wall, a wall thickness, and an inner volume, wherein the tube is coaxially aligned with the axis of the cartridge case, and wherein the outer diameter of the tube closely fits into the inner diameter of the shot cup;

d) two or more times, sequentially [i] inserting the leading edge of the tube into the shot cup to a sufficient depth to cause at least a portion of the shot load and buffer to rise into the inner volume of the tube, and [ii] removing the tube from the shot cup, wherein the tube is completely removed from the shot cup after the final inserting step; and e) crimping or closing the cartridge case.

Aspect 35. A process for loading a cartridge with a buffered shot shell cartridge, the process comprising:

a) providing or obtaining a cartridge case having a fore end and an aft end, the cartridge case having an inner diameter and comprising a cartridge head and a primer at the aft end;

b) sequentially loading into the cartridge case [i] a propellant adjacent the primer, [ii] an obturating component, and [iii] in any order, a shot load and a buffer charge;

c) providing or obtaining a tube having a length, a circular leading edge, an outer diameter, an inner wall, a wall thickness, and an inner volume, wherein the tube is coaxially aligned with the axis of the cartridge case, and wherein the outer diameter of the tube closely fits into the inner diameter of the cartridge case;

d) two or more times, sequentially [i] inserting the leading edge of the tube into the cartridge case to a sufficient depth to cause at least a portion of the shot load and buffer to rise into the inner volume of the tube, and [ii] removing the tube from the cartridge case, wherein the tube is completely removed from the cartridge case after the final inserting step; and e) crimping or closing the cartridge case.

Definitions

To define more clearly the terms used herein, the following definitions are provided, which are applicable to this disclosure unless otherwise indicated by the present disclosure or the context. To the extent that any definition or usage provided by any document incorporated herein by reference conflicts with the definition or usage provided herein, the definition or usage provided herein controls. Terms that are not specifically defined will be readily understood by the person of ordinary skill in the art.

The "aft end" of the cartridge is the primer end that is rearward (up range) facing when the cartridge is aligned in its intended position for firing. The "fore end" or "forward end" of the cartridge is the crimped or closed end that is forward (downrange) facing when the cartridge is aligned in its intended position for firing.

By describing the tube as having an outer diameter that "closely fits" into the inner diameter of the shot cup or cartridge case, it is intended to reflect a fit of the tube within the shot cup or cartridge case by one or more of the following measures: [i] the outer diameter of the tube is such that the outer surface of the tube is in contact with the inner surface of the shot cup or cartridge when coaxially inserted; [ii] the tube is as large as possible to allow coaxial insertion into the shot cup or cartridge, but not so large that, upon removal of the tube, the shot cup or cartridge is carried with the tube; [iii] when coaxially inserted into the shot cup or cartridge, the distance between the outer surface of the tube and the inner surface of the shot cup or cartridge is less than half the diameter (or have the average size) than the smallest shot being loaded; [iv] when coaxially inserted into the shot cup or cartridge, the distance between the outer surface of the tube and the inner surface of the shot cup or cartridge is less than 45%, 40%, 35%, 30%, 25%, 20%, 15%, 10%, or 5% of the diameter (or average size) of the smallest shot being loaded; and/or [v] the tube should be sufficiently large to not capture any shot or solid projectile between the outer surface of the tube and the inner surface of the shot cup or cartridge upon inserting the leading edge of the tube into the shot cup or cartridge to a sufficient depth to cause at least a portion of the shot load or payload to rise into the inner volume of the tube.

The term "shot cup" is used according to the understanding of the person of ordinary skill to reflect a cylindrical container that is open at one end and closed at the other into which shot and buffer are added, the cylindrical side wall of which can be longitudinally split or weakened to form vanes that will open upon firing if desired. As explained herein, the shot cups can be standalone cups without any obturating or gas seal portion or can part of a larger wad that can also include an obturating or gas seal section and/or a collapsible section. Thus, as the context allows or requires, any type shot cup can be used, for example, a shot cup without an obturating section and/or collapsible section, or one that is a portion of a larger wad that can include an over-propellant obturating portion and/or a collapsible section.

As the context allows, the term "cartridge" can refer to the finished manufactured article, such as a completed ammunition cartridge, or refer to the cartridge "case" or "hull" that is loaded according to the process described herein. The particular utility will be apparent to the person of ordinary skill and according to the context in which the term is use.

Reference to an "obturating component" or obturating member can include any component, whether pre-formed or not, that can provide a seal against expanding propellant gases, and can comprise, can consist of, or can be a pre-formed gas seal or an obturating medium. Unless the context requires otherwise or unless otherwise provided, the term gas seal also can refer to either a pre-formed gas seal or an obturating medium. Moreover, when describing a gas seal as a pre-formed gas seal includes the a separate component or a component integrated into a more complex payload delivery system, such as a wad that can include a shot cup and/or a collapsible section, as the context requires.

Throughout this specification, various publications may be referenced. The disclosures of these publications are hereby incorporated by reference in pertinent part, in order to more fully describe the state of the art to which the disclosed subject matter pertains. The references disclosed are also individually and specifically incorporated by reference herein for the material contained in them that is discussed in the sentence in which the reference is relied upon. To the extent that any definition or usage provided by any document incorporated herein by reference conflicts with the definition or usage provided herein, the definition or usage provided herein controls.

As used in the specification and the appended claims, the singular forms "a," "an," and "the" include plural referents, unless the context clearly dictates otherwise. Thus, for example, reference to "a projectile" includes a single projectile such as a slug, as well as any combination of more than one projectile, such as multiple pellets of shot of any size or combination of sizes. Also for example, reference to "a projectile" includes multiple particles of a chemical composition or mixture of compositions that constitutes a projectile, and the like.

Throughout the specification and claims the word "comprise" and variations of the word, such as "comprising" and "comprises," means "including but not limited to," and is not intended to exclude for example, other additives, components, elements, or steps. While compositions and methods are described in terms of "comprising" various components or steps, the compositions and methods can also "consist essentially of" or "consist of" the various components or steps.

"Optional" or "optionally" means that the subsequently described element, component, step, or circumstance can or cannot occur, and that the description includes instances where the element, component, step, or circumstance occurs and instances where it does not.

Values or ranges may be expressed herein as "about", from "about" one particular value, and/or to "about" another particular value. When such values or ranges are expressed, other embodiments disclosed include the specific value recited, from the one particular value, and/or to the other particular value. Similarly, when values are expressed as approximations, by use of the antecedent "about," will be understood that the particular value forms another embodiment. It will be further understood that there are a number of values disclosed herein, and that each value is also herein disclosed as "about" that particular value in addition to the value itself. In an aspect, the term "about" can mean within 25%, within 20%, within 15%, within 10%, within 5%, within 2% or within 1% of the recited value. In another aspect, the term "about" can be used to reflect normal error in measurement according to the particular measurement method.

In any application before the United States Patent and Trademark Office, the Abstract of this application is provided for the purpose of satisfying the requirements of 37 C.F.R. § 1.72 and the purpose stated in 37 C.F.R. § 1.72(b) "to enable the United States Patent and Trademark Office and the public generally to determine quickly from a cursory inspection the nature and gist of the technical disclosure." Therefore, the Abstract of this application is not intended to be used to construe the scope of the claims or to limit the scope of the subject matter that is disclosed herein. Moreover, any headings that are employed herein are also not intended to be used to construe the scope of the claims or to limit the scope of the subject matter that is disclosed herein. Any use of the past tense to describe an example otherwise indicated as constructive or prophetic is not intended to reflect that the constructive or prophetic example has actually been carried out.

Those skilled in the art will readily appreciate that many modifications are possible in the exemplary embodiments disclosed herein without materially departing from the novel teachings and advantages according to this disclosure. Accordingly, all such modifications and equivalents are intended to be included within the scope of this disclosure as defined in the following claims. Therefore, it is to be understood that resort can be had to various other aspects, embodiments, modifications, and equivalents thereof which, after reading the description herein, may suggest themselves to one of ordinary skill in the art without departing from the spirit of the present disclosure or the scope of the appended claims.

What is claimed is:

1. A process for loading a buffered shot shell cartridge, the process comprising:

a) providing or obtaining a cartridge case having a fore end and an aft end, the cartridge case having an inner diameter and comprising a cartridge head and a primer at the aft end;

b) sequentially loading into the cartridge case [i] a propellant adjacent the primer, [ii] an obturating component, [iii] a shot cup having an inner diameter, and [iv] in any order, a shot load and a buffer charge;

c) coaxially aligning a tube with the axis of the cartridge case, wherein the tube has a length, a circular leading edge, an outer diameter, an inner wall, a wall thickness, and an inner volume, and wherein the outer diameter of the tube closely fits into the inner diameter of the shot cup; and d) one or more times, sequentially [i] inserting the leading edge of the tube into the shot cup to a sufficient depth to cause at least a portion of the shot load and buffer charge to rise into the inner volume of the tube, and [ii] removing the tube from the shot cup.

2. A process according to claim 1, further comprising the step of crimping the cartridge case.

3. A process according to claim 1, wherein the shot cup and the obturating component are combined into a single wad.

4. A process according to claim 1, wherein the obturating component is selected from a preformed gas seal or a granular obturating medium.

5. A process according to claim 1, wherein the wall thickness of the tube is [i] from about 0.010 inch to about 0.015 inch; or [ii] less than or about half the diameter of the smallest shot in the shot load.

6. A process according to claim 1, wherein the step of sequentially inserting and removing the tube is carried out n times, wherein n is from 1 to 10 times.

7. A process according to claim 1, wherein at least one step of sequentially inserting and removing the tube comprises inserting the leading edge of the tube into the shot cup until it contacts the bottom of the shot cup.

8. A process according to claim 1, wherein the step of sequentially inserting and removing the tube is carried out n times, wherein n is from 2 to 10 times, and wherein [i] the depth of insertion of the tube in each of the second or greater step is the same or greater than the depth of insertion in the previous step or [ii] the depth of insertion of the tube in each of the second or greater step is the same or less than the depth of insertion in the previous step.

9. A process according to claim 1, wherein at least one step of sequentially inserting and removing the tube comprises [i] inserting the tube to a sufficient depth that at least or about half of the shot load rises into the inner volume of the tube or [ii] inserting the tube to a sufficient depth that less than half of the shot load rises into the inner volume of the tube.

10. A process according to claim 1, wherein the buffer charge comprises polyethylene, polypropylene, polystyrene, polyester, polyamide, or a combination thereof.

11. A process according to claim 1, wherein the buffer charge comprises polymer particles having an average size of from about 0.002 inch to about 0.190 inch.

12. A process according to claim 1, wherein the shot load comprises birdshot, buckshot, or a combination thereof.

13. A process according to claim 1, wherein the shot load comprises shot pellets having a shot size of #12, #11, #10, #9, #8, #7½, #6, #5, #4, #3, #2, #1, or #BB lead pellet size.

14. A process according to claim 1, wherein the shot load comprises lead, steel, bismuth, tungsten, tin, iron, copper, zinc, aluminum, nickel, chromium, molybdenum, cobalt, manganese, antimony, alloys thereof, composites thereof, and any combinations thereof.

15. A process according to claim 1, wherein the shot load comprises a multiplex shot load comprising shot of two or more different sizes.

16. A process for loading a buffered shot shell cartridge, the process comprising:

a) providing or obtaining a cartridge case having a fore end and an aft end, the cartridge case having an inner diameter and comprising a cartridge head and a primer at the aft end;

b) sequentially loading into the cartridge case [i] a propellant adjacent the primer, [ii] an obturating component, and [iii] in any order, a shot load and a buffer charge;

c) coaxially aligning a tube with the axis of the cartridge case, wherein the tube has a length, a circular leading edge, an outer diameter, an inner wall, a wall thickness, and an inner volume, and wherein the outer diameter of the tube closely fits into the inner diameter of the cartridge case; and d) one or more times, sequentially [i] inserting the leading edge of the tube into the cartridge case to a sufficient depth to cause at least a portion of the shot load to rise into the inner volume of the tube, and [ii] removing the tube from the cartridge case.

17. A process according to claim 16, further comprising the step of crimping the cartridge case.

18. A process according to claim 16, wherein the obturating component is selected from a preformed gas seal or a granular obturating medium.

19. A process according to claim 16, wherein the wall thickness of the tube is [i] from about 0.010 inch to about 0.015 inch; or [ii] less than or about half the diameter of the smallest shot in the shot load.

20. A process according to claim 16, wherein the step of sequentially inserting and removing the tube is carried out n times, wherein n is from 1 to 10 times.

21. A process according to claim 16, wherein the step of sequentially inserting and removing the tube is carried out n times, wherein n is from 2 to 10 times, and wherein [i] the depth of insertion of the tube in each of the second or greater step is the same or greater than the depth of insertion in the previous step or [ii] the depth of insertion of the tube in each of the second or greater step is the same or less than the depth of insertion in the previous step.

22. A process according to claim 16, wherein at least one step of sequentially inserting and removing the tube comprises [i] inserting the tube to a sufficient depth that at least or about half of the shot load rises into the inner volume of the tube or [ii] inserting the tube to a sufficient depth that less than half of the shot load rises into the inner volume of the tube.

23. A process according to claim 16, wherein the buffer charge comprises polymer particles having an average size of from about 0.002 inch to about 0.190 inch.

24. A process according to claim 16, wherein the shot load comprises birdshot, buckshot, or a combination thereof.

* * * * *